US009940910B1

(12) United States Patent
Stewart

(10) Patent No.: US 9,940,910 B1
(45) Date of Patent: Apr. 10, 2018

(54) APPARATUS AND SYSTEM FOR STRETCHING A STRING OF A MUSICAL INSTRUMENT AND CORRESPONDING METHOD THEREOF

(71) Applicant: Shane Stewart, Nashville, TN (US)

(72) Inventor: Shane Stewart, Nashville, TN (US)

( * ) Notice: Subject to any disclaimer, the term of this patent is extended or adjusted under 35 U.S.C. 154(b) by 0 days.

(21) Appl. No.: 15/297,771

(22) Filed: Oct. 19, 2016

Related U.S. Application Data

(60) Provisional application No. 62/243,375, filed on Oct. 19, 2015.

(51) Int. Cl.
*G10D 3/00* (2006.01)

(52) U.S. Cl.
CPC ..... *G10D 3/00* (2013.01)

(58) Field of Classification Search
CPC ..... G10D 3/00
See application file for complete search history.

(56) References Cited

U.S. PATENT DOCUMENTS

2002/0038596 A1* 4/2002 Lome ..... G10D 3/10 84/458

* cited by examiner

*Primary Examiner* — Kimberly Lockett
(74) *Attorney, Agent, or Firm* — Patterson Intellectual Property Law, P.C.; Mark J. Patterson; Grant M. Ford

(57) ABSTRACT

A string stretching apparatus, system and method are described. The string stretching apparatus may include lower and upper raised portions at an outer surface of a body of the stretching apparatus. A portion of the body of the string stretching apparatus may be placed in contact with a neck of a musical instrument. The lower and upper raised portions may be configured to extend outwardly to extend a distance between the neck of the musical instrument and at least one string of the musical instrument. The string stretching apparatus may be manipulable in a longitudinal direction of the neck of the musical instrument, and either or both of the lower and upper raised portions may be configured to rotate, in order to increase or decrease string tension.

17 Claims, 9 Drawing Sheets

APPARATUS AND SYSTEM FOR STRETCHING A STRING OF A MUSICAL INSTRUMENT AND CORRESPONDING METHOD THEREOF

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of U.S. Provisional Patent Application No. 62/243,375, dated Oct. 19, 2015, entitled "APPARATUS AND SYSTEM FOR STRETCHING A STRING OF A MUSICAL INSTRUMENT AND CORRESPONDING METHOD THEREOF," and which is hereby incorporated by reference in its entirety.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to a musical instrument string stretching apparatus and a method of stretching musical instrument strings using the apparatus.

When stringing a guitar or other musical instrument, care is provided to proper tuning so as to provide the proper sound output for the new string. However, through use and over time, a guitar string will go out of tune. This can be caused by numerous factors, such as strings stretching over time from use, loose tuning pegs, humidity and temperature, etc.

Many guitar players currently employ a method of manually stretching guitar strings in an attempt to avoid detuning. For example, many guitar players will manually extend each string at a plurality of fret locations in an attempt to slow or prevent detuning. However, such a manual operation is time-consuming, may cause pain to a user, introduces risk that a string being extended outward may break, and may require frequent stretching and tuning. Thus, a need exists for an apparatus which provides a quick, efficient, and longer-lasting stretching mechanism for strings of a musical instrument.

BRIEF SUMMARY OF THE INVENTION

One embodiment of the present invention provides a string stretching apparatus for stretching at least one string of a musical instrument. The string stretching apparatus includes a body having at least one surface which is configured to be placed in contact with a surface of the musical instrument, at least one raised portion configured to fit between the at least one string and the body, and at least one notch configured to receive the at least one raised portion therein.

Another embodiment of the present invention provides a method of tensioning at least one string of a musical instrument using a stretching apparatus. The method includes placing a stretching apparatus between the at least one string of the musical instrument and a neck of the musical instrument, and tensioning the at least one string of the musical instrument by increasing a height of the at least one string relative to the neck of the musical instrument when the stretching apparatus is placed between the at least one string and the neck of the musical instrument.

A further embodiment of the present invention provides a system for stretching at least one string of a musical instrument. The system includes a musical instrument and a string stretcher. The musical instrument includes a body having a neck, and at least one string extending along the neck. The string stretcher includes a body having at least one surface which is configured to be placed in contact with the neck of the musical instrument, at least one raised portion configured to fit between the at least one string and the neck, and at least one notch configured to receive the at least one raised portion therein.

Numerous other objects, features, and advantages of the present invention will be readily apparent to those skilled in the art upon a reading of the following disclosure when taken in conjunction with the accompanying drawings.

DETAILED DESCRIPTION OF THE INVENTION

Figure 1:
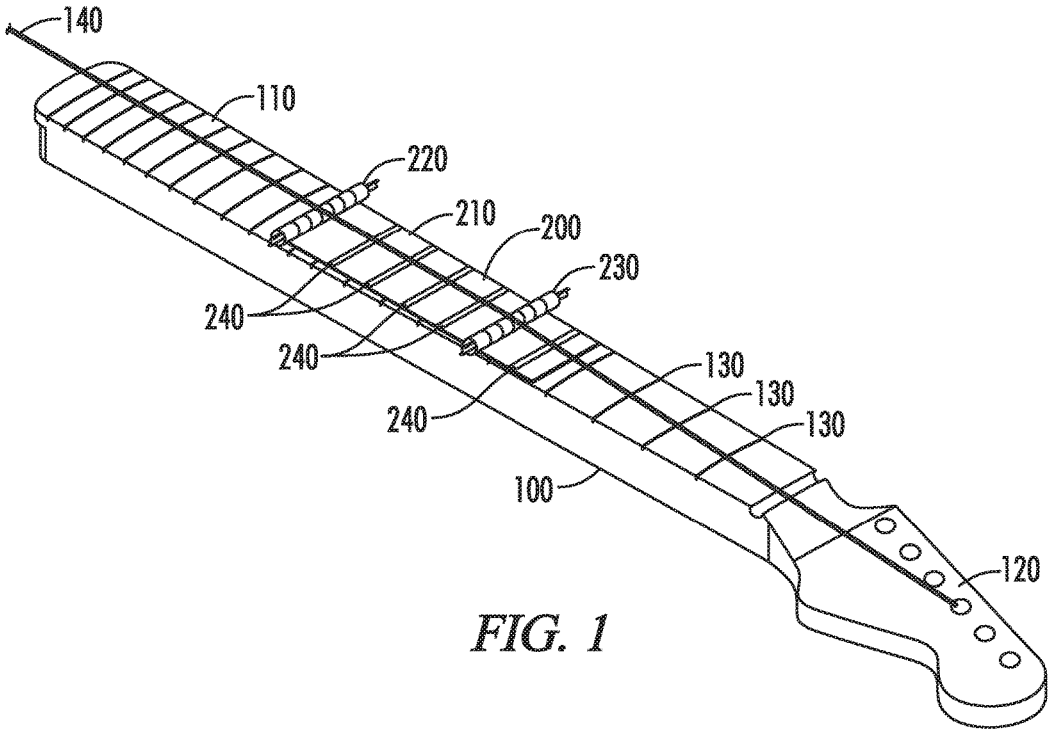
FIG. 1 is a raised front perspective view of a stretching apparatus according to an exemplary embodiment.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Referring generally to FIGS. 1-11, various exemplary apparatuses and associated methods according to the present disclosure are described in detail. Where the various figures may describe embodiments sharing various common elements and features with other embodiments, similar elements and features are given the same reference numerals and redundant description thereof may be omitted below.

Various embodiments of an apparatus according to the present invention may provide an instrument string stretching device. The stretching device may be designed, for example, for use with stringed instruments such as acoustic guitars, electric guitars, bass guitars, banjoes, violins, cellos, harps, pianos, ukuleles, mandolins, or any instrument utilizing a string in tension. Although described as being used in the context of a musical instrument, the stretching apparatus of the present disclosure may additionally or alternatively be used in non-musical instrument implementations where a string is used, where the string has a desired tuning and/or tautness.

As shown in FIG. 1, in one exemplary embodiment, a stretching apparatus 200 may comprise a body 210, lower raised portion 220, upper raised portion 230, and at least one notch 240. The body 210 may be configured to be placed at an outer surface of a neck 110 of a musical instrument 100. As described above, although the musical instrument 100 is illustrated as a guitar, any stringed instrument or device may be used as the musical instrument 100. Musical instrument 100 may comprise a neck 110, a head 120, at least one fret 130, and at least one string 140. While the at least one string 140 is illustrated as extending beyond an end surface of the neck 110, the at least one string 140 may be connected to a base or body of the musical instrument 100 as understood in the art.

The stretching apparatus 200 may be configured to be placed between the at least one string 140 and neck 110 of the musical instrument 100. This may be accomplished, for example, by moving the stretching apparatus 200 in a perpendicular direction relative to a longitudinal surface along the neck 110 in a direction connecting a head and a body of the musical instrument. That is to say that the stretching apparatus 200 may be positioned, in one embodiment, by sliding the stretching apparatus between the at least one string 140 and the neck 110.

When placed between the at least one string 140 and neck 110, the stretching apparatus may provide additional tension to the at least one string 140 using the lower and upper raised portions 220 and 230. In one embodiment, the at least one string 140 may be configured to be received at one or more groove G located at one or more of the lower and upper raised portions 220 and 230. When placed in one or more grooves G, the at least one string 140 may be placed in additional tension and, as a result, may be stretched in a direction extending outward from the neck 110 of musical instrument 100.

In one embodiment, the lower and upper raised portions 220 and 230 may be configured to be removable from the stretching apparatus 200 and/or may be replaceable. For example, in one embodiment at least one of the lower and upper raised portions 220 and 230 may be configured to be removed from one of the at least one notch 240. The removed raised portion 220 and/or 230 may be configured to then be placed into a second notch of the at least one notch 240. Alternatively, the stretching apparatus may be configured to operate using only one of the lower and upper raised portions 220 and 230. In another embodiment, the stretching apparatus 200 may be configured to operate with more than two raised members (for example in large-sized musical instruments having strings extending five or more feet in length). In one exemplary embodiment, the at least one notch 240 may be formed between two or more frets of a musical instrument by at least one of the stretching apparatus 200 and a surface of the musical instrument between the at least two frets. In embodiments where the at least one notch is formed between at least two frets, at least a portion of the stretching apparatus may be configured to fit within at least a portion of the at least one notch 240.

In addition to being removable and replaceable, at least one of the lower and upper raised portions 220 and 230 may be configured to be manipulable within the stretching apparatus 200. For example, at least one of the lower and upper raised portions 220 and 230 may permit rotation in a clockwise or counter-clockwise direction relative to a longitudinal face of the neck 110 of musical instrument 100. Each of the lower and upper raised portions 220 and 230 may, in one embodiment, possess an elongated ellipse shape. As such, an amount of tension or stretching may be modified by rotating at least one of the lower and upper raised portions 220 and 230 in a clockwise or counter-clockwise direction based on a height of each lower and upper raised portion 220 and 230, as manipulated, based on the elliptical shape of the lower and upper raised portions 220 and 230.

Although the lower and upper raised portions 220 and 230 are described as possessing an elongated elliptical shape, the raised portions may comprise a number of alternative shapes. For example, in one embodiment, at least one of the lower and upper raised portions 220 and 230 may comprise a cylindrical shape, a rectangular prism shape, a hexagonal prism shape, a cuboid shape, a cone shape, or any other shape capable of creating tension and stretching the at least one string 140 of musical instrument 100.

Figure 2:
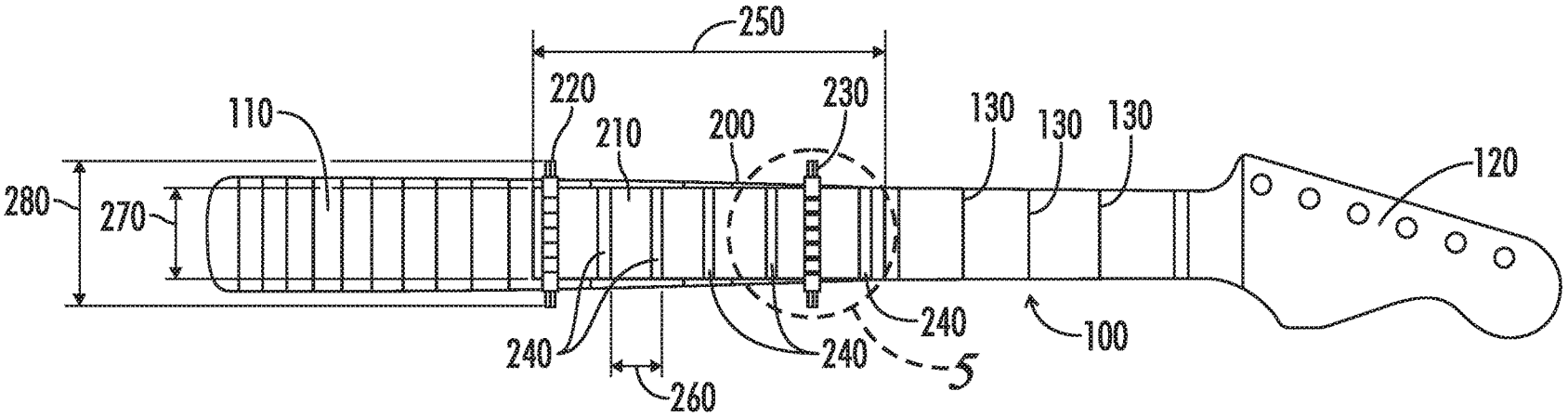
FIG. 2 is a top view of a stretching apparatus according to an exemplary embodiment.

FIG. 2 illustrates a top view of a stretching apparatus 200 according to an exemplary embodiment. In the embodiment illustrated at FIG. 2, musical instrument 100 may correspond to a guitar as known in the art. A width of the neck 110 of musical instrument 100 may be configured such that at least a portion of the width of neck 110 perpendicular to the longitudinal direction of the neck 110 narrows as the neck 110 extends outwardly from a base of the musical instrument 100 in a longitudinal direction. As such, a width 280 of the stretching apparatus 200 may be configured to be greater than a width of the neck 110 across the longitudinal length of the neck 110 of musical instrument 100.

Although illustrated in the Figures as being stationary, the stretching apparatus 200 may be configured to move along a longitudinal direction of the neck 110 of musical instrument 100. As understood in the art, a distance between a neck 110 of a musical instrument 100 and the at least one string 140 may be variable based upon a specific location on the neck 110 of musical instrument 100. For example, the gap distance between the neck 110 and at least one string 140 may increase in a longitudinal direction of the neck 110 extending away from the head 120 towards the body or base of musical instrument 100. In one embodiment, the stretching apparatus 200 may be configured to adjust to the variable gap distance in various configurable ways. For example, as previously described, at least one of the lower and upper raised portions 220 and 230 may be removed and/or attached at a particular one of the at least one notches 240.

In the embodiment illustrated by FIG. 2, there may be seven notches 240 over a width 250 of the body 210 of stretching apparatus 200, although the number of notches 240 may vary. In the embodiment illustrated at FIG. 2, a width 260 between adjacent notches 240 may be configured using a predetermined distance and/or a variable distance, for example, corresponding to a particular musical instrument 100 type or size, or a characteristic of a particular musical instrument 100.

Figure 3A:
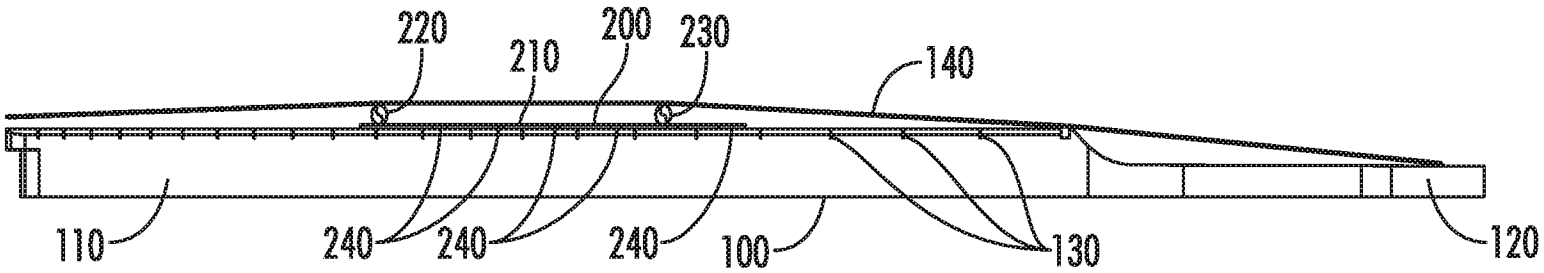
FIGS. 3A and 3B are a side view of a stretching apparatus and a representative alignment of the stretching apparatus, respectively, according to an exemplary embodiment.
Figure 3B:
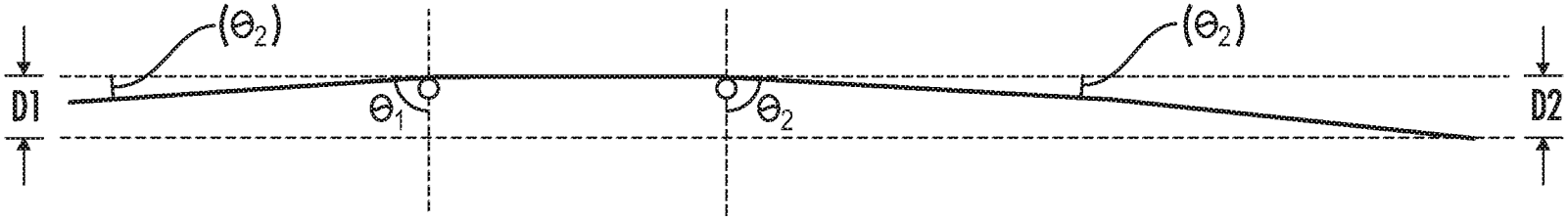

FIGS. 3A and 3B illustrate a side view of a stretching apparatus and a representative alignment of the stretching apparatus, respectively, according to an exemplary embodiment. As illustrated by FIGS. 3A and 3B, the lower and upper raised portions may extend outwardly from an outer surface of neck 110 of musical instrument 100. The stretching apparatus 200 may be configured to contact at least one surface of the neck 110 of musical instrument 100.

An angle of the at least one string 140 relative to a longitudinal axis of the neck 110 of musical instrument 100 may vary, for example, based upon a location of the stretching apparatus 200 relative to the neck 110. For example, lower and upper raised portions 220 and 230 may cause the at least one string 140 to form at least one angle offset from an axis parallel to the neck 110. In one exemplary implementation, a first angle $\Theta_1$ of the at least one string 140 may be formed based upon a vertical offset $D_1$ associated with the lower raised portion 220, while a second angle $\Theta_2$ of the at least one string 140 may be formed based upon a vertical offset $D_2$ associated with the upper raised portion 230. As previously noted, a position of the stretching apparatus 200 and a vertical offset $D_1$ or $D_2$ associated with the stretching apparatus 200 may be manipulated along a length of the neck 110. As a location or vertical offset is manipulated, at least one of angles $\Theta_1$ and $\Theta_2$ may be modified as a result of the manipulation.

Figure 4:
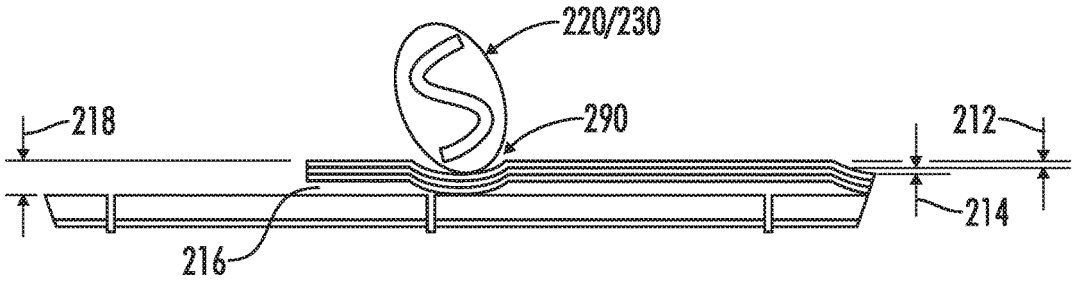
FIG. 4 is a partial side view of a stretching apparatus according to an exemplary embodiment.

FIG. 4 illustrates a partial side view of a portion of the stretching apparatus 200. Stretching apparatus 200 may comprise a plurality of materials and/or components of varying thickness. For example, stretching apparatus 200 may in one embodiment comprise an upper section 212 and a lower section 214. Upper section 212 may comprise any of a plurality of materials. In one exemplary embodiment, the upper section 212 may be formed of a leather material. Lower section 214 may be formed of a more rigid material, for example, a metal or hard plastic. The upper section 212 and lower section 214 may comprise the same thickness in one embodiment, or in an alternate embodiment, may comprise separate thicknesses to arrive at a stretching apparatus height 218.

As illustrated by FIG. 4, the stretching apparatus height 218 may comprise at least one gap 216 between a lower surface of the lower section 214 and the neck 110 of musical instrument 100. The stretching apparatus 200 may comprise at least one cavity 290, into which at least a portion of at least one of lower and upper raised portions 220 and 230 may be received. In one embodiment, the at least one cavity 290 may comprise at least one of the notches 240. That is to say that the at least one notch 240 may comprise a cavity 290 configured to receive at least a portion of a lower or upper raised portion 220 or 230. The cavity 290 may in one embodiment be configured to permit at least one of the lower and upper raised portions 220 and 230 to be rotated or otherwise manipulated within at least a portion of the cavity 290. For example, a height and/or tension or stretching amount associated with at least one of the lower and upper raised portions 220 or 230 may be configured to be modified according to a rotation position or other manipulable property of a lower or raised portion 220 or 230.

Contact between the stretching apparatus 200 and an outer surface of neck 110 of musical instrument 100 may take place at one or more contact points. The one or more contact points may, in one embodiment, correspond to a bottom surface of stretching apparatus 200 located at one or more cavity 290. Thus, in one embodiment, only a portion of a bottom surface of the stretching apparatus 200 may be placed in contact with an outer surface of the neck 110 of musical instrument 100.

Figure 5:
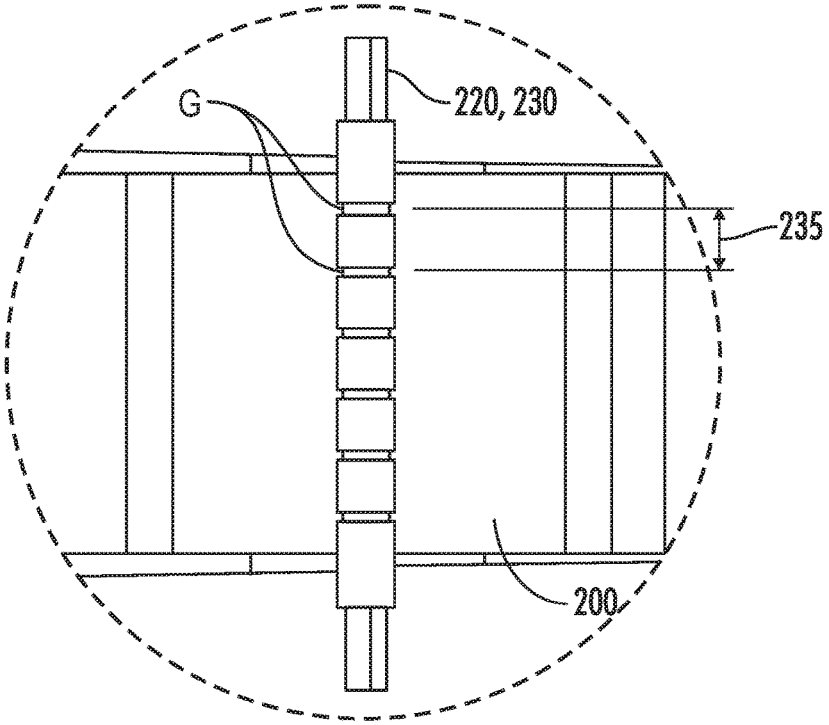
FIG. 5 is a partial top view of a portion of a stretching apparatus according to an exemplary embodiment.

FIG. 5 illustrates a partial top view of a stretching apparatus 200 according to an exemplary embodiment. In FIG. 5, a lower or upper raised portion 220 or 230 may comprise a plurality of grooves G. In one embodiment, a number of the grooves G may correspond to a number of strings associated with a musical instrument 100 intended for use with the stretching apparatus 200. Alternatively, a number of grooves G may correspond to a predetermined number selected for permitting a maximum number of musical instruments 100 with which the stretching apparatus 200 may operate. For example, a stretching apparatus 200 may be configured such that it is operable with a plurality of acoustic and electric guitars, as well as with a traditional four string bass guitar based on the locations of grooves G on at least one of lower and upper raised portions 220 and/or 230.

In one embodiment, a gap 235 may exist between at least two of grooves G. The gap 235 may, in one embodiment, correspond to a standard distance between two or more strings 140 associated with musical instrument 100. For example, a gap 235 may correspond to a distance between at least two of grooves G (e.g., within a range of 0.2 to 0.5 inches, such as 0.29 inches), in order to correspond to a traditional acoustic or electric guitar string distance. Alternatively, a distance correspond to gap 235 may be enlarged or contracted In order to modify a tension or angle associated with at least one string 140. For example, grooves 140 may be configured such that additional tension is placed on at least one string 140 during operation relative to placing each groove G at a standard distance associated with an intended musical instrument 100.

Figure 6:
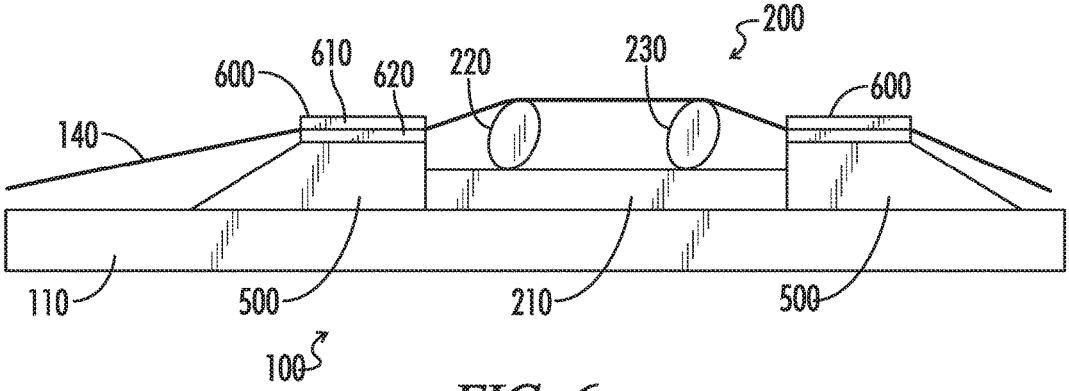
FIG. 6 is a partial side view of a stretching apparatus according to an exemplary embodiment.

FIG. 6 illustrates a side view of a stretching apparatus according to an exemplary embodiment. In FIG. 6, the stretching apparatus 200 may comprise one or more ramps 500 connected thereto. In one embodiment, the stretching apparatus 200 may comprise two ramps 500 connected at opposing ends of the body 210 of the stretching apparatus 200. However, either one or three or more of ramps 500 may be implemented with stretching apparatus 200 within the spirit and the scope of the present disclosure. Each ramp 500 may be configured to have at least one string holder 600 located at an upper surface thereof extended outwardly from the neck 110 of the musical instrument 100. In one embodiment, at least a portion of the at least one string 140 may be placed in contact with a surface of the ramp 500. Alternatively, a relationship between the ramp 500 and string holder 600 may be such that no portion of the at least one string 140 is placed in contact with the ramp 500.

One or more string holders 600 may be located at an upper surface of each ramp 500. Each string holder 600 may be configured to receive at least one string 140 in a cavity therein. String holder 600 may comprise an upper section 610 and a lower section 620. A bottom surface of the upper section 610 and a top surface of the lower section 620 may comprise grooves therein so as to form at least one opening 630 at an inner surface of the string holder 600 when the upper section 610 and lower section 620 are placed in contact with one another. In one embodiment, the one or more string holders 600 may be configured to open between the upper section 610 and the lower section 620 to permit at least one string 140 to be received by the at least one opening 630. In one implementation, opening 630 may comprise a receiving material such as felt or other non-abrasive material to receive the at least one string 140 without damaging the at least one string 140. Upon exiting the one or more string holders 600 into an inner portion of the string stretcher 200, the at least one string 140 may be stretched outwardly relative to the body 110 of the musical instrument 100 in order to fit over at least a portion of a lower or upper raised portion 220 or 230. Alternatively, or in combination with the previously described implementation, the at least one string 140 may be configured to variously be placed in contact with one or more upper and/or lower surfaces of one or more lower or upper raised portions 220 or 230.

Each ramp 500 may connect to the stretching apparatus 200 using a plurality of attachment methods. In one implementation, each ramp 500 may be fixedly connected to at least a portion of the stretching apparatus 200. In another implementation, each ramp 500 may be rotatably connected to the stretching apparatus 200. For example, in one embodiment, one or more ramps 500 may be configured to rotate in a clockwise or counter-clockwise direction in order to permit reversibility of the string stretcher 200. For example, the string stretcher 200 may operate in multiple physical configurations based on a movement or rotation of at least one ramp 500 connected thereto. In one embodiment, both upper and lower surfaces of the string stretcher 200 may receive at least one of the one or more lower or upper raised portions 220 or 230. In one embodiment, a first surface of the string stretcher 200 may have a first physical appearance or physical attribute for a first desired configuration, while a second surface of the string stretcher 200 may have a second physical appearance or physical attribute for a second desired configuration. For example, in one exemplary embodiment, opposing sides of the string stretcher 200 may comprise separate physical appearances or material types. In another embodiment, the one or more sides of the string stretcher 200 may comprise various heights or thicknesses which may affect the operation of the string stretcher 200 in practice.

In one exemplary embodiment, the musical instrument 100 may comprise a guitar having six strings. The stretching apparatus 200 may comprise two ramps 500 located at opposing ends of the body 210 of the stretching apparatus 200. Each ramp 500 may comprise a string holder 600 located at an upper surface thereof. An upper portion 610 and lower portion 620 of each string holder 600 may be configured to form six openings 630 therebetween, in a configuration to receive the six strings of the guitar (e.g., by using a predetermined or standardized string spacing).

Figure 7A:
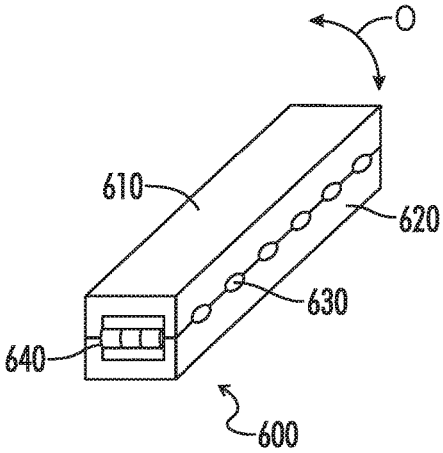
FIGS. 7A and 7B illustrate perspective views of an open and closed string holder, respectively, according to an exemplary embodiment.
Figure 7B:
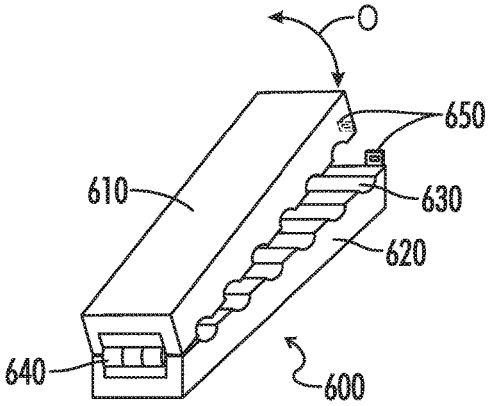

FIGS. 7A and 7B illustrate opened and closed perspective views of a string holder 600 in accordance with the present disclosure. As illustrated, a string holder 600 may comprise an upper portion 610 and lower portion 620 having one or more openings 630 formed therebetween. The string holder 600 may be configured to open and close according to an opening direction O. Movement in the opening direction O may, in one embodiment, be implemented using a hinge 640. The hinge 640 may contain a spring therein to provide pressure either in or opposite to the opening direction O. Thus, in one embodiment, the hinge 640 may operate to keep the upper portion 610 and lower portion 620 in contact with one another. Alternatively or in addition to pressure from hinge 640, the string holder 600 may comprise a locking means 650 configured to maintain a particular distance between the upper portion 610 and lower portion 620. For example, the particular distance may be such that the upper portion 610 and lower portion 620 are in constant contact while the locking means 650 is active. Alternatively, the particular distance may be configured to form a predetermined distance between the upper portion 610 and the lower portion 620.

Figure 8:
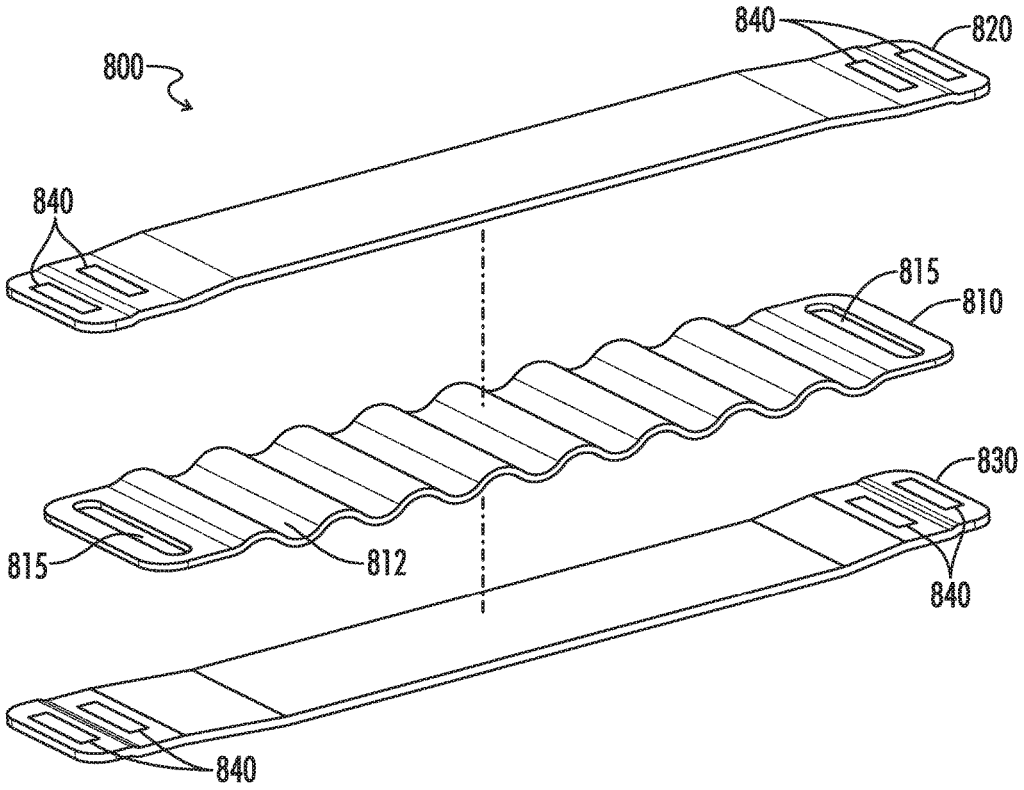
FIG. 8 illustrates a partial exploded view of a body of a string stretching apparatus according to an exemplary embodiment.

FIG. 8 illustrates a partial exploded view of a body 800 of a string stretching apparatus according to an exemplary embodiment. The body 800 includes a central member 810, an upper member 820, and a lower member 830. In one exemplary embodiment, the central member 810 is made from a rigid material, such as metal or any other material capable of maintaining a shape or position when one or more forces are applied to the central member 810. In the embodiment illustrated by FIG. 8, the body 800 includes a wavy configuration having at least one notch 812. Although illustrated as having a wavy configuration, it should be appreciated that in various embodiments, at least a portion of the central member 810 may have a flat configuration, and that the at least one notch 812 may include either a gap or an additional material at the central member 812. The at least one notch 812 of the central member 810 is configured to receive therein at least one raised portion (e.g., lower raised portion 220 or upper raised portion 230).

The central member 810 includes at least one opening 815. Although illustrated as extending through the central member 810, it should be appreciated that in one or more embodiments, the opening 815 may extend through only a portion of the central member 810. The at least one opening 815 is configured to contact the central member 810 and at least one of the upper member 820 and the lower member 830, and to provide a fastening location therebetween in one or more embodiments. For example, the central member 810 is configured to couple to the upper member 820 and the lower member 830 via a fastener (not illustrated) in one embodiment. The fastener may be any fastening means known in the art, such as stitching, glue, hook-and-loop fastener, or any other material or means configured to couple the central member 810 to at least one of the upper member 820 and the lower member 830.

The upper member 820 and the lower member 830 are constructed from a soft and/or flexible material in one embodiment. For example, each of the upper member 820 and the lower member 830 are formed from genuine or imitation leather in various implementations. The central member 810, the upper member 820, and the lower member 830 are configured to couple to one another via at least one connection section 840. The at least one connection section 840 is configured to correspond to at least one opening 815 in an exemplary embodiment. One or more of the connection sections 840 are used to connect the central member 810 to at least one of the upper member 820 and the lower member 830. At least one of the connection sections 840 may be omitted or may be nonfunctional in various embodiments, without departing from the spirit and the scope of the present disclosure.

Figure 9:
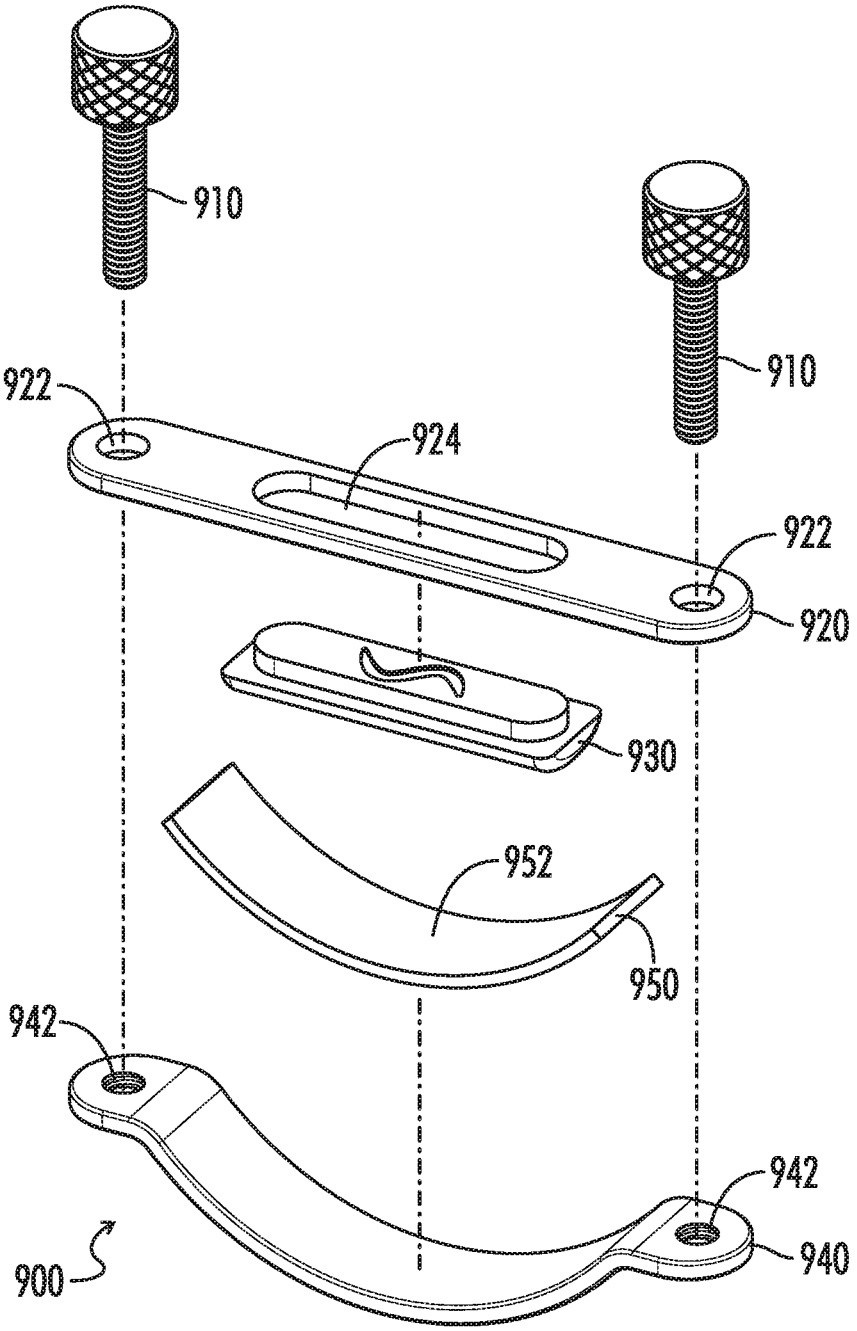
FIG. 9 illustrates an exploded view of a string guide according to an exemplary embodiment.

FIG. 9 illustrates an exploded view of a string guide 900 according to an exemplary embodiment. The string guide 900 is configured to connect to a musical instrument (e.g., musical instrument 100) and to be placed in contact with at least one string (e.g., string 140 of musical instrument 100). The string guide 900 includes at least one fastener 910. In one exemplary embodiment, the fastener 910 is a screw (for example, a thumb screw), although any fastening means may be used as the fastener 910. The string guide 900 further includes a connection plate 920. The connection plate 920 includes at least one through hole 922 in embodiments where the fastener 910 is configured to pass through at least a portion of the connection plate 920. The connection plate 920 is a steel plate in one exemplary embodiment, although any material capable of providing sufficient rigidity for coupling to the fastener 910 may be used.

The connection plate 920 includes a receiving portion 924 in an exemplary embodiment. The receiving portion 924 is configured to receive at least a portion of a contact module 930. The contact module 930 is configured to be placed in contact with at least one string (e.g., string 140) of a musical instrument (e.g., musical instrument 100). The contact module 930 is made from silicone in one embodiment, although any material capable of being placed in contact with the at least one string 140 of the musical instrument 100 without causing damage to the at least one string or the musical instrument may be used without departing from the spirit and the scope of the present disclosure.

The string guide 900 of FIG. 9 includes a base section 940. In one exemplary embodiment, the base section 940 includes at least one through hole 942 through which the fastener 910 is configured to pass. The base plate 940 is a steel plate in one exemplary embodiment, although any material capable of providing sufficient rigidity for coupling to the fastener 910 may be used. A contact element 950 is coupled to a surface of the base section 940 in one exemplary embodiment. The contact element 950 is configured to be placed between the base plate 940 and a contact surface of the musical instrument 100 during use. The contact element 950 may be a material selected to contact the musical instrument 100 without damaging the musical instrument 100. For example, the contact element 950 may be made of leather or a similar material. In an embodiment where the musical instrument 100 is a guitar, an inner surface 952 of the contact element 950 is configured to be placed in contact with a curved surface of a neck of the guitar.

In various embodiments, a size and a shape of each component of the string guide 900 may be provided or modified to correspond to one or more particular musical instruments or types of musical instruments. For example, although illustrated as having a curved surface, it should be appreciated that at least one of the base section 940 and contact element 950 are configured to correspond to a musical instrument, and thus may be curved, linear, or any shape or size depending upon a particular implementation. The string guide 900 is configured to be used on a musical instrument 100 without contacting the body 800 of the string stretching apparatus in one exemplary embodiment. As such, although described as being a part of a string stretching apparatus or system, at least one part of the string guide 900 is capable of being physically separate from one or more sections of the body 800, without departing from the spirit and the scope of the present disclosure. Additionally or alternatively, at least one of the string guide 900 and the body 800 may be configured to couple to one another in various embodiments.

The string guide 900 is configured in one exemplary embodiment is be fitted to a musical instrument (e.g., musical instrument 100) by placing the connection plate 920 and contact module 930 (i.e., first portion) at one contact surface of the musical instrument (e.g., facing a fretboard when the musical instrument 100 is a guitar) and the base section 940 and the contact element 950 (i.e., second portion) at an opposing surface of the musical instrument (e.g., along the back of a neck of a guitar). The at least one through hole 922 and the at least one through hole 942 are configured to align in one embodiment such that the fastener 910 is configured to pass through at least a portion of the through holes 922 and 942 to couple the first portion of the string guide 900 to the second portion of the string guide 900 and thereby form the string guide 900. Although illustrated with respect to a single string guide 900, string stretching apparatuses consistent with the present disclosure are configured to include a plurality of string guides (e.g., at opposing ends of the string stretching apparatus) in various embodiments, without departing from the spirit and the scope of the present disclosure.

Figure 10:
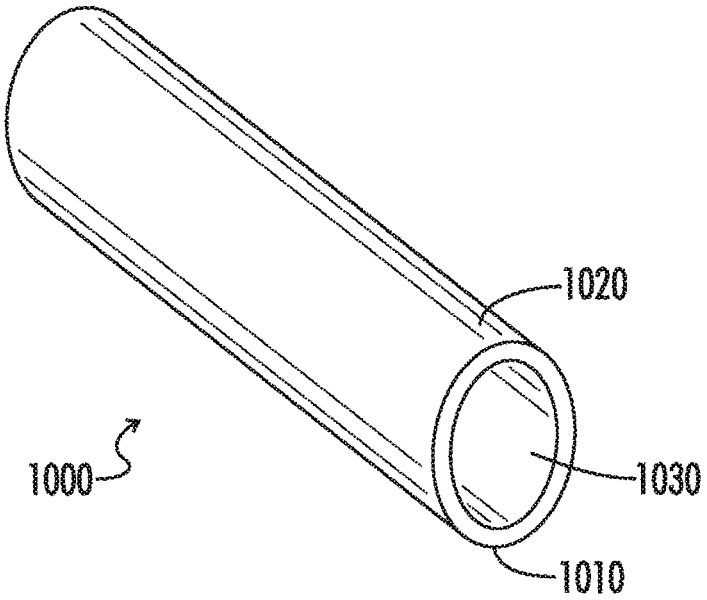
FIG. 10 illustrates a raised perspective view of a raised portion in accordance with an exemplary embodiment.

FIG. 10 illustrates a raised perspective view of a raised portion 1000 in accordance with an exemplary embodiment. The raised portion 1000 is configured to be placed in contact with each of the at least one string 140 of the musical instrument 100 and a string stretching apparatus in the manner previously described herein. Although illustrated as in FIG. 10 as having an elongated elliptical shape, it should be appreciated that a shape of the raised portion 1000 is configured to correspond to at least one of a musical instrument and a string of a musical instrument to which the raised portion is to be coupled. In one exemplary embodiment, the raised portion 1000 is configured to be received at the least one notch 240 of the stretching apparatus 200. The raised portion 1000 illustrated by FIG. 10 is configured to serve as at least one of the lower raised portion 220 and the upper raised portion 230 previously described herein.

The raised portion 1000 includes a stretching apparatus contact portion 1010, a string contact portion 1020, and an opening 1030. The stretching apparatus contact portion 1010 is configured to be placed in contact with a surface of a stretching apparatus. For example, the stretching apparatus contact portion 1010 is configured in one exemplary embodiment to be placed in contact with the at least one notch 240 of the stretching apparatus 200. The string contact portion 1020 is configured to be placed in contact with a string (e.g., the at least one string 140) of a musical instrument (e.g., musical instrument 100). The raised portion 1000 is configured in one exemplary embodiment to form therein a hollow inner portion illustrated in FIG. 10 as the opening 1030.

The opening 1030 is configured in one embodiment to extend along a longitudinal axis of the raised portion 1000. Alternatively, the opening 1030 is configured in various embodiments to not extend fully through the raised portion 1000, and may optionally be filled with the same or a different material from the raised portion 1000 (e.g., plastic or foam within the opening 1030). The raised portion 1000 is an elliptical metal tube in one exemplary embodiment. The raised portion 1000 may be constructed out of any material capable of providing sufficient rigidity to stretch the at least one string 140 of the musical instrument 100. In various embodiments, at least a portion of the raised portion 1000 is configured to flex and/or stretch according to one or more forces acting upon the raised portion 1000 (for example, at the string contact portion 1020 and/or the stretching apparatus contact portion 1010). The raised portion 1000 may be selected in various embodiments to correspond to one or more characteristics of at least one of a musical instrument. For example, in one embodiment the raised portion 1000 having a high rigidity is configured to correspond to a desire to place a high tension on the at least one string 140 during use, whereas a raised portion 1000 having a lower rigidity is configured to correspond to a desire to place a lower tension on the at least one string 140 (e.g., for use with an antique musical instrument or weaker string).

Figure 11:
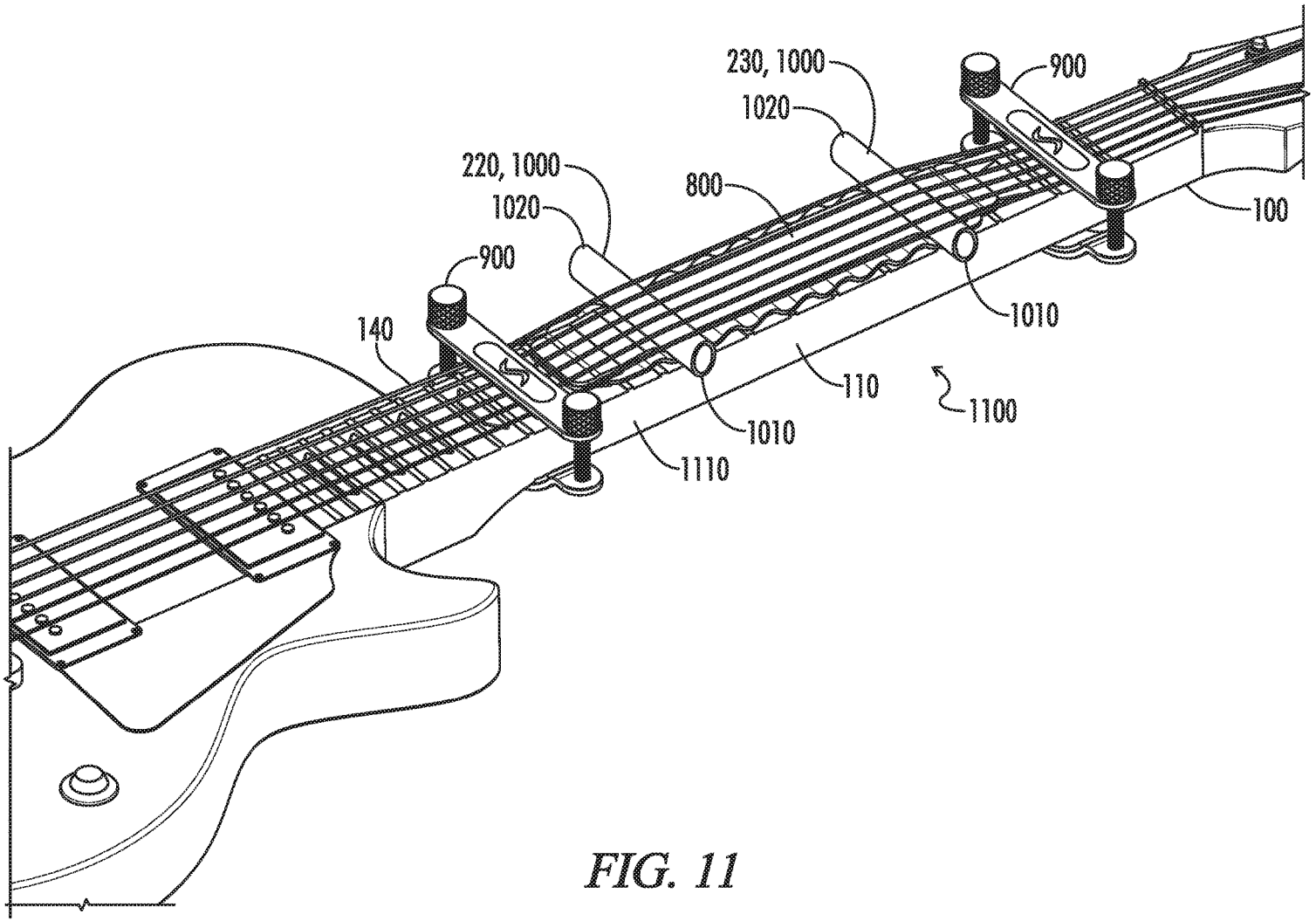
FIG. 11 illustrates a partial raised perspective view of a musical instrument having a stretching apparatus applied thereto in accordance with an exemplary embodiment.

FIG. 11 illustrates a partial raised perspective view of a musical instrument 100 having a stretching apparatus 1100 applied thereto in accordance with an exemplary embodiment. The stretching apparatus 1100 of FIG. 11 includes a body 800 having a lower raised portion 220 and an upper raised portion 230 in contact with at least one string 140 along neck 110 of the musical instrument 100. The stretching apparatus 1100 further includes two string guides 900 placed in contact with a rear surface 1110 of the neck 110 of the musical instrument 100. As previously described herein, the stretching apparatus 1100 is configured such that the contact module 930 of each string guide 900 is in contact with the at least one string 140 of the musical instrument 100 while the at least one string 140 is in contact with the string contact portion 1020 of each string guide 900. The body 800 of the stretching apparatus is configured to be placed in contact with the stretching apparatus contact portion 1010 of the lower raised portion 220 and the upper raised portion 230.

Implementing the stretching apparatus 1100 as illustrated, for example, by FIG. 11 and various embodiments provided herein results in providing an apparatus for a musical instrument which quickly, safely, and efficiently enables string stretching.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A string stretching apparatus for stretching at least one string of a musical instrument, the string stretching apparatus comprising:

a body having:

at least one surface which is configured to be placed in contact with a surface of the musical instrument, a central member;

an upper member configured to be placed contact with at least a portion of the central member, the upper member being located between the central member at the at least one raised portion; and a lower member configured to be placed in contact with at least a portion of the central member and at least a portion of the musical instrument;

at least one raised portion configured to fit between the at least one string and the body; and at least one notch in the body configured to receive the at least one raised portion therein.

2. The string stretching apparatus of claim 1, further comprising:

at least one ramp connected to the body of the string stretching apparatus;

a string holder located at a top surface of the at least one ramp, the string holder being configured to receive the at least one string.

3. The string stretching apparatus of claim 1, further comprising:

at least one string guide connected to at least one of the musical instrument and the body of the string stretching apparatus, the at least one string guide being configured to contact the at least one string and the at least one raised portion.

4. The string stretching apparatus of claim 3, wherein the at least one raised portion comprises a first raised portion and a second raised portion, and wherein the at least one string guide comprises a first string guide and a second string guide.

5. The string stretching apparatus of claim 4, wherein (i) the body includes a first end and a second end located at an opposing side of the body, (ii) the first raised portion and the first string guide are located at the first end, and (iii) the second raised portion and the second string guide are located at the second end.

6. The string stretching apparatus of claim 1, wherein the at least one notch is formed in a surface of the body and further wherein the at least one raised portion is configured to be placed in contact between the at least one string and the at least one notch.

7. The string stretching apparatus of claim 1, wherein the at least one raised portion is configured to be placed in contact with the lower member at the at least one notch at a first side and to be placed in contact with the at least one string at a second side, wherein the second side is at an opposite surface of the at least one raised portion from the first side.

8. A method of tensioning at least one string of a musical instrument using a stretching apparatus, the method comprising:

placing a stretching apparatus between the at least one string of the musical instrument and a neck of the musical instrument; and tensioning the at least one string of the musical instrument by increasing a height of the at least one string relative to the neck of the musical instrument at a tensioning location when the stretching apparatus is placed between the at least one string and the neck of the musical instrument, wherein the placing the stretching apparatus between the at least one string of the musical instrument and the neck of the musical instrument includes inserting a raised portion between the stretching apparatus and the musical instrument at the tensioning location.

9. The method of claim 8, further comprising:

providing a string guide in contact with the at least one string at opposing ends of the stretching apparatus to limit a section of the at least one string under tension associated with the stretching apparatus.

10. The method of claim 8, wherein the placing a stretching apparatus between the at least one string of the musical instrument and the neck of the musical instrument further includes selecting the raised portion based on a characteristic of at least one of the musical instrument and the at least one string.

11. A system for stretching at least one string of a musical instrument, the system comprising:

a musical instrument including:

a body having a neck; and at least one string extending along the neck; and a string stretcher including:

a body having at least one surface which is configured to be placed in contact with the neck of the musical instrument;

at least one raised portion configured to fit between the at least one string and the neck; and at least one notch in the body configured to receive the at least one raised portion therein, wherein the at least one raised portion comprises a first raised portion and a second raised portion, and wherein the string stretcher includes at least one string guide comprising a first string guide and a second string guide.

12. The system of claim 11, further comprising:

at least one ramp connected to the body of the string stretcher;

a string holder located at a top surface of the at least one ramp, the string holder being configured to receive the at least one string.

13. The system of claim 11, wherein:

the at least one string guide is connected to at least one of the musical instrument and the body of the string stretcher, the at least one string guide being configured to contact the at least one string and the at least one raised portion.

14. The system of claim 11, wherein (i) the body includes a first end and a second end located at an opposing side of the body, (ii) the first raised portion and the first string guide are located at the first end, and (iii) the second raised portion and the second string guide are located at the second end.

15. The system of claim 11, wherein the at least one notch is formed in a surface of the body and further wherein the at least one raised portion is configured to be placed in contact between the at least one string and the at least one notch.

16. The system of claim 11, wherein the body comprises:

a central member;

an upper member configured to be placed contact with at least a portion of the central member, the upper member being located between the central member at the at least one raised portion; and a lower member configured to be placed in contact with at least a portion of the central member and at least a portion of the musical instrument.

17. The system of claim 16, wherein the at least one raised portion is configured to be placed in contact with the lower member at the at least one notch at a first side and to be placed in contact with the at least one string at a second side, wherein the second side is at an opposite surface of the at least one raised portion from the first side.

* * * * *